US011071422B2

(12) United States Patent
Gong et al.

(10) Patent No.: US 11,071,422 B2
(45) Date of Patent: Jul. 27, 2021

(54) ASSEMBLY AND DISASSEMBLY BASE

(71) Applicant: Bestter (Xiamen) Technology Inc., Xiamen (CN)

(72) Inventors: Binhua Gong, Xiamen (CN); Jian Li, Xiamen (CN)

(73) Assignee: Bestter (Xiamen) Technology Inc., Xiamen (CN)

( * ) Notice: Subject to any disclaimer, the term of this patent is extended or adjusted under 35 U.S.C. 154(b) by 0 days.

(21) Appl. No.: 16/817,959

(22) Filed: Mar. 13, 2020

(65) Prior Publication Data

US 2020/0288926 A1 Sep. 17, 2020

(30) Foreign Application Priority Data

Mar. 13, 2019 (CN) ..... 201920315460.1

(51) Int. Cl.
*A47K 13/26* (2006.01)
*A47K 13/12* (2006.01)

(52) U.S. Cl.
CPC ..... *A47K 13/26* (2013.01); *A47K 13/12* (2013.01)

(58) Field of Classification Search
CPC ..... A47K 13/12; A47K 13/26
See application file for complete search history.

(56) References Cited

U.S. PATENT DOCUMENTS 7,281,276 B2 * 10/2007 Vierkant, III ..... A47K 13/12 4/236
9,144,354 B2 * 9/2015 Yang ..... A47K 13/26

* cited by examiner

*Primary Examiner* — Christine J Skubinna
(74) *Attorney, Agent, or Firm* — Cooper Legal Group, LLC

(57) ABSTRACT

The present disclosure discloses an assembly and disassembly base. The assembly and disassembly base comprises a fixed plate set, a locking plate, and a fixing screw, the fixed plate set and the locking block are disposed with a plurality of protruding blocks, the locking plate is slidably disposed in the fixed plate set, the protruding blocks are overlapped and staggered, thereby resulting the locking and the disassembly of the locking plate and the fixed plate set to be achieved. The locking plate is connected to the toilet seat by the fixing screw.

8 Claims, 5 Drawing Sheets

ASSEMBLY AND DISASSEMBLY BASE

RELATED APPLICATIONS

This application claims priority to Chinese Patent Application 201920315460.1, filed on Mar. 13, 2019, which is incorporated herein by reference.

FIELD OF THE DISCLOSURE

The present disclosure relates to an assembly and disassembly base.

BACKGROUND OF THE DISCLOSURE

Toilets are a convenience tool and are used by many families. Toilets generally comprise a toilet seat and a toilet cover, and the toilet cover is generally pivotally attached to the toilet seat. Since the toilet cover is usually fixedly connected to the toilet seat by screws, it is difficult to disassemble, which makes the toilet cover and the toilet seat difficult to clean, replace, and repair.

BRIEF SUMMARY OF THE DISCLOSURE

The present disclosure provides an assembly and disassembly base for the connection between the toilet cover and the toilet seat and is intended to solve deficiencies of the existing techniques.

In order to solve the aforementioned technical problems, a technical solution of the present disclosure is as follows.

An assembly and disassembly base comprises a fixed plate set, a locking plate, and a fixing screw. The fixed plate set comprises a connecting member and at least one fixed plate. The connecting member is configured to connect to rotating holes disposed on both sides of a toilet cover of a toilet, and the at least one fixed plate is disposed on a first side of the connecting member. Each of the at least one fixed plate comprises a housing and a flip cover. The housing is hollow and a bottom end of the housing comprises an opening. A plurality of locking blocks are disposed on a first side wall and a second side wall of the opening, and the first side wall of the opening is opposite to the second side wall of the opening. The plurality of locking blocks 131 and a side wall of the housing adjacent to the connecting member define a cavity. A top end of the cavity is disposed with a positioning hole, and the flip cover is disposed at a first end of the housing away from the connecting member. The flip cover is disposed with a positioning fastener, and a position of the positioning fastener corresponds to a position of the positioning hole. The locking plate comprises at least two protruding blocks and a body. The at least two protruding blocks are disposed on two sides of a top surface of the body at intervals and are disposed corresponding to the plurality of locking blocks. The locking plate is slidably disposed in the housing, and positions of top surfaces of each of the at least two protruding blocks and positions of bottom surfaces of corresponding locking blocks of the plurality of locking blocks of the at least one fixed plate are overlapped and staggered. The locking plate is connected to a toilet seat of the toilet by the fixing screw.

In another preferred embodiment, the housing is disposed with a first strip hole, a center of the locking plate is disposed with a second strip hole, and the fixing screw downwardly passes through the first strip hole from and is locked to the second strip hole.

In another preferred embodiment, the second strip hole is a stepped hole, a size of an upper hole of the stepped hole is the same as a size of the first strip hole, and a size of the lower hole of the stepped hole is smaller than the size of the upper hole. The fixing screw comprises a head portion and a rod portion. The head portion is disposed in the upper hole, and the rod portion passes through the second strip hole to lock the locking plate to the toilet seat.

In another preferred embodiment, a length of the positioning fastener is configured to enable the flip cover to abut a first side of the locking plate after the flip cover is flipped down, and the first side of the locking plate is perpendicular to a movement direction of the locking plate.

In another preferred embodiment, the housing comprises an anti-off hole, and the flip cover comprises a protruding rod corresponding to a position of the anti-off hole.

In another preferred embodiment, the connecting member comprises a connecting seat and two connecting sleeves disposed on opposite ends of the connecting seat, and an inner side of each of the two connecting sleeves is disposed with a damper.

In another preferred embodiment, the at least one fixed plate comprises two fixed plates, and the two fixed plates are respectively disposed at a first side of the two connecting sleeves away from a toilet tank of the toilet.

In another preferred embodiment, the at least two protruding blocks comprise at least four protruding blocks. The at least four protruding blocks are evenly disposed on the two sides of the top surface of the body at intervals. A number of the plurality of locking blocks is equal to a number of the at least four protruding blocks. A space between a first locking block and a second locking block of the plurality of locking blocks on each of the two sides enables a corresponding one of the at least four protruding blocks to pass through, and the first locking block is adjacent to the second locking block.

Compared with existing techniques, the technical solution of the present disclosure has the following advantages.

1. Four protruding blocks and four locking blocks form an "I-shaped" plate, which facilitates movement of the locking plate in the housing. It is only necessary to slide the toilet cover relative to the toilet seat in the horizontal direction to realize assembly and disassembly, guaranteeing the stability of the process.

2. The positioning fastener is disposed on the flip cover, which avoids obstructions in the process of inserting the locking plate into the housing and greatly facilitates the assembly and disassembly of the fixed plate set and the locking plate.

3. The arrangement of the second strip hole and its stepped shape not only ensures a certain displacement deviation during the sliding process, but also forms the space for the head portion of the fixing screw. Thus the head portion does not abut the flip cover, which enables the positioning fastener to be inserted into the anti-off hole to ensure stable installation of the toilet cover.

BRIEF DESCRIPTION OF THE DRAWING

The present disclosure will be further described below with the combination of the accompanying drawings and the embodiments.

DETAILED DESCRIPTION OF THE EMBODIMENTS

Embodiment 1

Referring to FIGS. 1-7, an assembly and disassembly base of Embodiment 1 comprises a fixed plate set 100, at least one locking plate 3, and at least one fixing screw 2.

Figure 1:
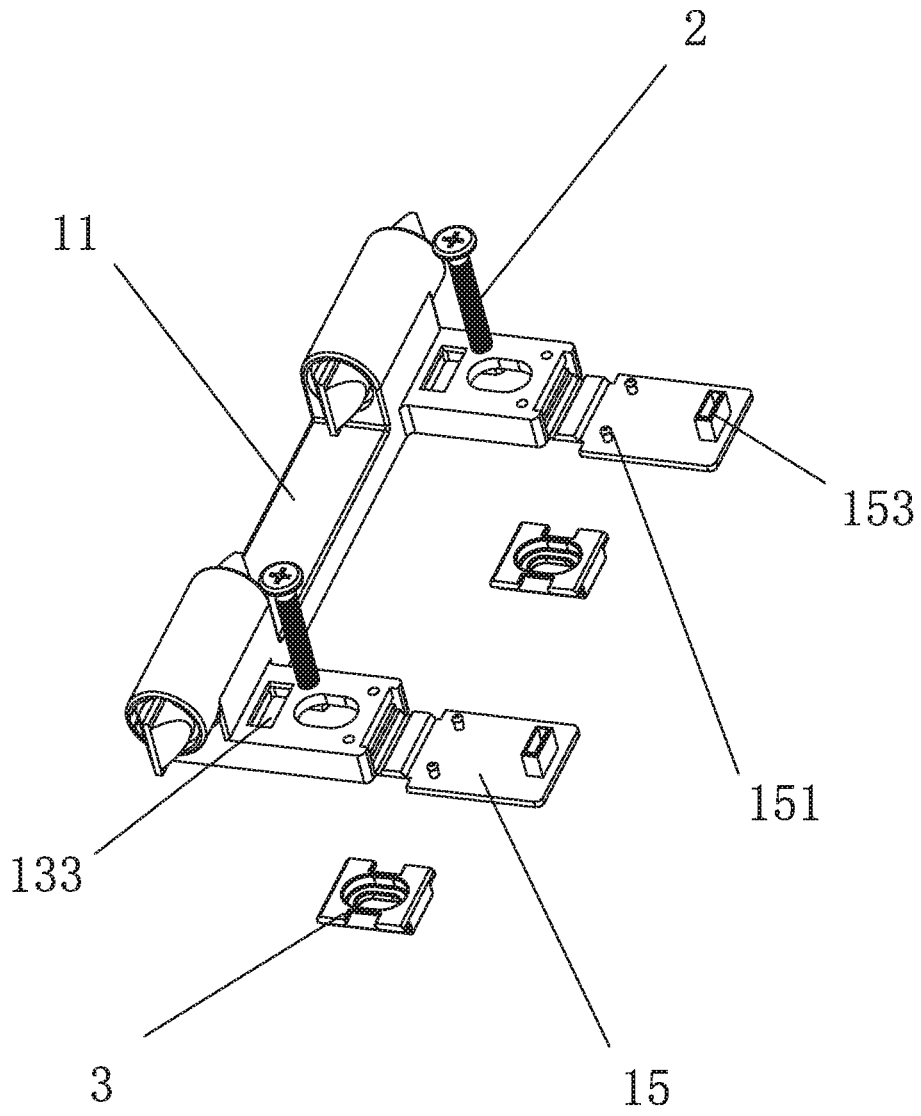
FIG. 1 is an exploded view of an assembly and disassembly base of Embodiment 1.
Figure 2:
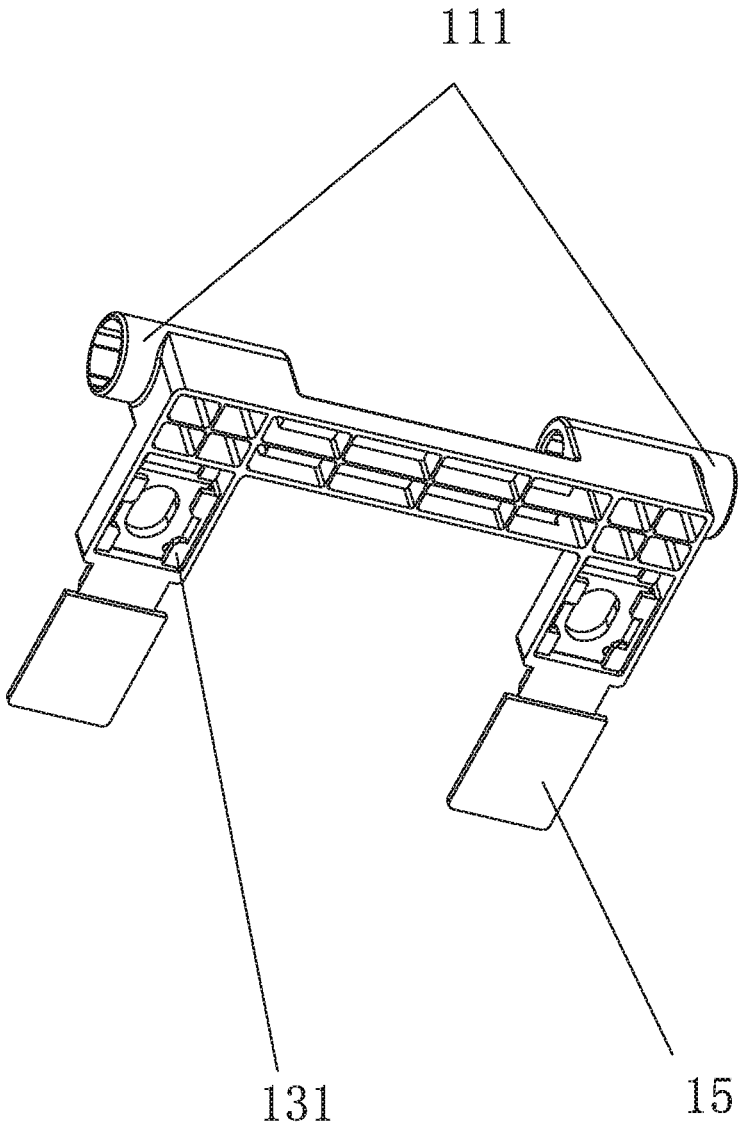
FIG. 2 is a schematic view of a fixed plate set of Embodiment 1.

Referring to FIGS. 1 and 2, the fixed plate set 100 comprises a connecting member 11 and at least one fixed plate 10. The connecting member 11 is configured to connect to rotating holes disposed on both sides of a toilet cover. The at least one fixed plate 10 is disposed on a first side of the connecting member 11. In this embodiment, the connecting member 11 comprises a connecting base 112 and two connecting sleeves 111 disposed on opposite ends of the connecting base 112. An inner side of each of the two connecting sleeves 111 is disposed with a damper. The at least one fixed plate 10 comprises two fixed plates 10, and the two fixed plates 10 are respectively disposed on a first side of the two connecting sleeves 111 away from a toilet tank.

Each of the two fixed plates 10 comprises a housing 16 and a flip cover 15. The housing 16 is hollow, and a bottom end of the housing 16 comprises an opening 17. Edges of the opening 17 are disposed with a plurality of locking blocks 131. In this embodiment, the plurality of locking blocks 131 comprises four locking blocks 131, and a pair of the four locking blocks 131 is respectively disposed on a left side wall and a right side wall of the opening 17. The four locking blocks 131 and a side wall of the housing 16 adjacent to the connecting member 11 defines a cavity 132. A top end of the cavity 132 is disposed with a positioning hole 133. The flip cover 15 is disposed on a first end of the housing 16 away from the connecting member 11, and the flip cover 15 is disposed with a positioning fastener 153. A position of the positioning fastener 153 corresponds to a position of the positioning hole 133 to enable the positioning fastener 153 to be coupled to the positioning hole 133.

Figure 3:
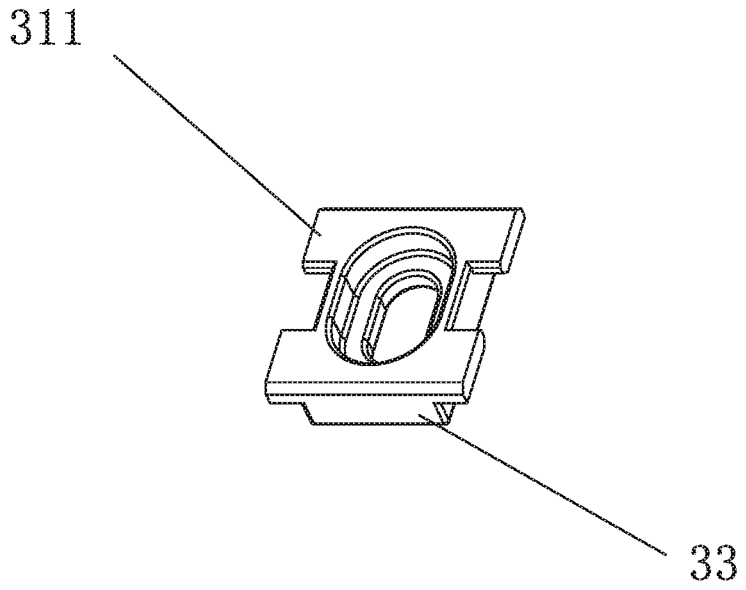
FIG. 3 is a schematic view of a locking plate of Embodiment 1.
Figure 4:
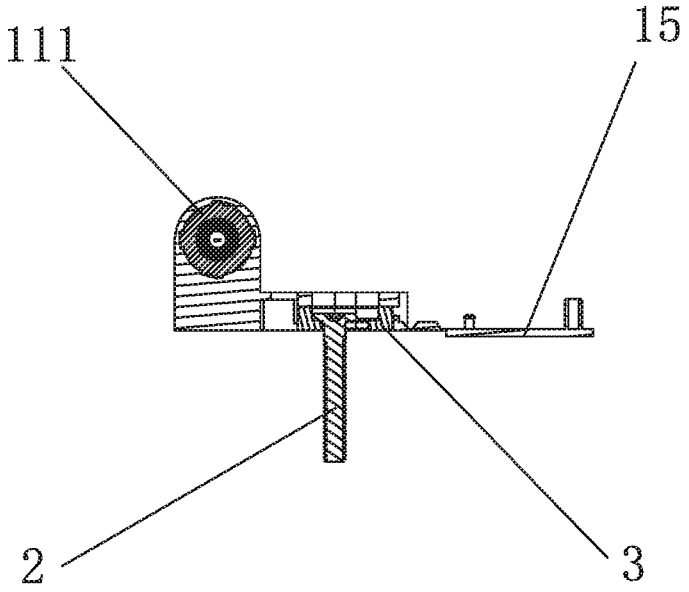
FIG. 4 is a cross-sectional view of the assembly and disassembly base of Embodiment 1.
Figure 5:
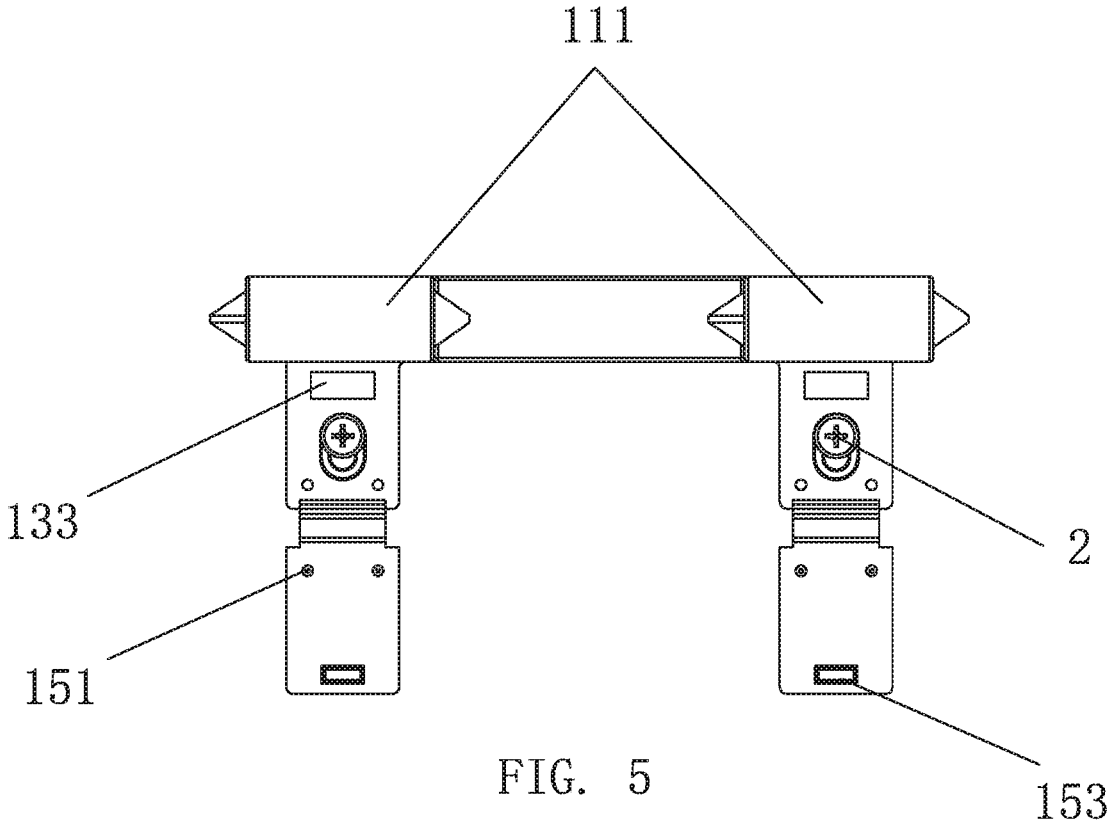
FIG. 5 is a top view of the assembly and disassembly base of Embodiment 1.
Figure 6:
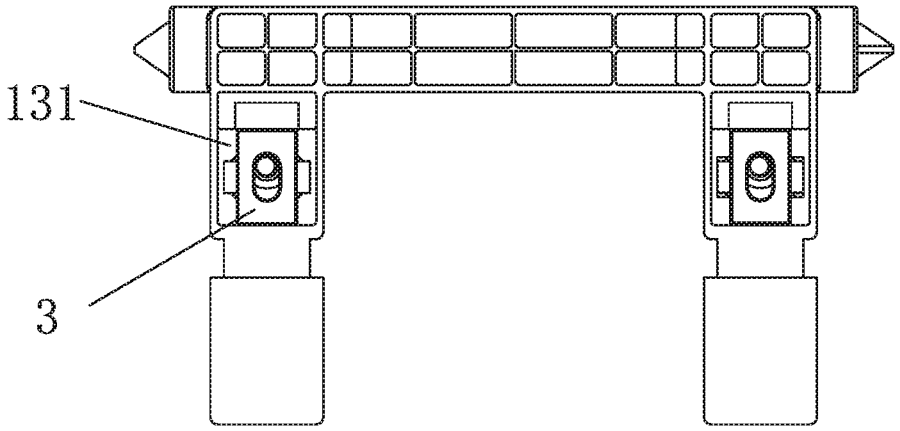
FIG. 6 is a schematic view of positions of a protruding block and a locking block of Embodiment 1 when the assembly and disassembly base is assembled.
Figure 7:
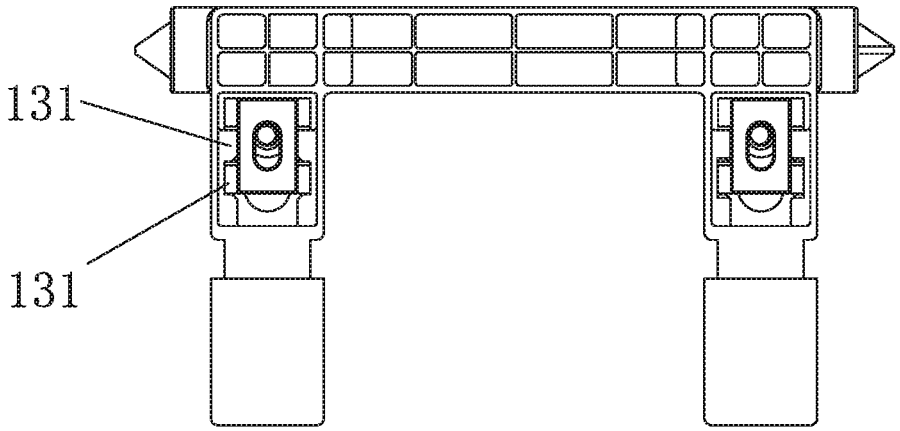
FIG. 7 is a schematic view showing the positions of the protruding block and the locking block of Embodiment 1 when the assembly and disassembly base is disassembled.

Referring to FIG. 3, each of the at least one locking plate 3 comprises a plurality of protruding blocks 311 and a body 33. The plurality of protruding blocks 311 are disposed on two sides of a top surface of the body 33 at intervals and are disposed corresponding to the plurality of locking blocks 131. Each of the at least one locking plate 3 is slidably disposed in a corresponding one of the housings 16. In this embodiment, for example, the plurality of locking blocks 131 comprises four locking blocks 131, and the plurality of protruding blocks 311 comprises four protruding blocks. Each of the at least one locking plate 3 is an I-shaped plate. Relative positions of the four protruding blocks 311 of each of the at least one locking plate 3 and the four locking blocks 131 of a corresponding one of the at least one fixed plate 10 are overlapped and staggered, and thereby enabling a locking and a disassembly of the at least one locking plate 3 and the fixed plate set 100 to be achieved. In this embodiment, an interval between each two of the four locking blocks 131 on the same side wall of the housing 16 is not smaller than a size of each of the four protruding blocks 311. A size of the cavity 132 is configured to at least satisfy a movement of the four protruding blocks 311.

The at least one locking plate 3 is connected to a toilet seat by the at least one fixing screw 2.

The housing 16 is disposed with a first strip hole 161, and a center of each of the at least one locking plate 3 is disposed with a second strip hole 32. The at least one fixing screw 2 downwardly passes through the first strip hole 161 and is locked to the second strip hole 32. In this embodiment, the second strip hole 32 is a stepped hole, and a size of an upper hole 321 of the stepped hole 32 at a top end of the body 33 is the same as a size of the first strip hole 161. A size of the lower hole 322 of the stepped hole 32 is smaller than the size of the upper hole 312. Each of the at least one fixing screw 2 comprises a head portion 21 and a rod portion 22. The at least one head portion 21 is disposed in the upper hole 321 to effectively prevent the at least one fixing screw 2 from abutting the flip cover 15 and to enable the positioning fastener 153 to be inserted into the positioning hole 133. The rod portion 22 passes through the second strip hole 32 to lock a corresponding one of the at least one locking plate 3 to the toilet seat to ensure a stable installation of the toilet cover.

A length of the positioning fastener 153 is configured to enable the flip cover 15 to abut a top surface of a corresponding one of the at least one locking plate 3 after the flip cover 15 is flipped down. A minimum height of the positioning fastener 153 is at least higher than a height of a corresponding one of the at least one locking plate 3 upon being horizontally disposed. In this embodiment, the positioning fastener 153 is a square block or a rectangular block. The square block or the rectangular block has a shape conformal to the shape of the positioning hole and is coupled to the positioning hole 133. A side wall of the square block or the rectangular block that abuts the at least one locking plate 3 is flat, which makes the positioning fastener 153 more stable.

The housing 16 comprises at least one anti-off hole 135, and the flip cover 15 comprises at least one protruding rod 151. A position of each of the at least one protruding rod 151 corresponds to a position of a corresponding one of the at least one anti-off hole 135, and each of the at least one protruding rod 151 is inserted into a rubber ring.

When the toilet cover is to be quickly assembled, a surface of each of the at least one locking plate 3 disposed with the four protruding blocks 311 faces upward, and the four protruding blocks 311 are inserted into the opening 17 at the bottom end of the housing 16. The toilet cover is pushed horizontally to move the fixed plate set 100, the four protruding blocks 311 cover on the four locking blocks 131, and the four protruding blocks 311 and the four locking blocks 131 are overlapped (see FIG. 6). Then, the at least one locking plate 3 is locked to the toilet seat by the at least one fixing screw 2 in a downward direction, the flip cover 15 is flipped downward, and the positioning fastener 153 is inserted into the positioning hole 133 to abut a corresponding one of the at least one locking plate 3 to prevent the corresponding one of the at least one locking plate 3 from sliding. The assembly is then complete. When the toilet cover is to be quickly disassembled, the flip cover 15 is flipped upward, and the toilet cover is pulled horizontally so that the four protruding blocks 311 and the four locking blocks 131 are staggered (see FIG. 7). The disassembly is then complete.

It will be apparent to those skilled in the art that various modifications and variation can be made in the present disclosure without departing from the spirit or scope of the invention. Thus, it is intended that the present disclosure cover the modifications and variations of this invention provided they come within the scope of the appended claims and their equivalents.

What is claimed is:

1. An assembly and disassembly base, comprising:
a fixed plate set,
a locking plate, and
a fixing screw, wherein:
the fixed plate set comprises a connecting member and at least one fixed plate,
the connecting member is configured to connect to rotating holes disposed on both sides of a toilet cover of a toilet,
the at least one fixed plate is disposed on a first side of the connecting member,
each of the at least one fixed plate comprises a housing and a flip cover,
the housing is hollow and a bottom end of the housing comprises an opening,
a plurality of locking blocks are disposed on a first side wall and a second side wall of the opening,
the first side wall of the opening is opposite to the second side wall of the opening,
the plurality of locking blocks and a side wall of the housing adjacent to the connecting member define a cavity,
a top end of the cavity is disposed with a positioning hole,
the flip cover is disposed at a first end of the housing away from the connecting member,
the flip cover is disposed with a positioning fastener,
a position of the positioning fastener corresponds to a position of the positioning hole,
the locking plate comprises at least two protruding blocks and a body,
the at least two protruding blocks are disposed on two sides of a top surface of the body at intervals and are disposed corresponding to the plurality of locking blocks,
the locking plate is slidably disposed in the housing,
positions of top surfaces of each of the at least two protruding blocks and positions of bottom surfaces of corresponding locking blocks of the plurality of locking blocks of the at least one fixed plate are overlapped and staggered, and
the locking plate is connected to a toilet seat of the toilet by the fixing screw.

2. The assembly and disassembly base according to claim 1, wherein:
the housing is disposed with a first strip hole,
a center of the locking plate is disposed with a second strip hole, and
the fixing screw downwardly passes through the first strip hole and is locked to the second strip hole.

3. The assembly and disassembly base according to claim 2, wherein:
the second strip hole is a stepped hole,
a size of an upper hole of the stepped hole is the same as a size of the first strip hole,
a size of a lower hole of the stepped hole is smaller than the size of the upper hole,
the fixing screw comprises a head portion and a rod portion,
the head portion is disposed in the upper hole, and
the rod portion passes through the second strip hole to lock the locking plate to the toilet seat.

4. The assembly and disassembly base according to claim 1, wherein:
a length of the positioning fastener is configured to enable the flip cover to abut a first side of the locking plate after the flip cover is flipped down, and
the first side of the locking plate is perpendicular to a movement direction of the locking plate.

5. The assembly and disassembly base according to claim 1, wherein:
the housing comprises an anti-off hole, and
the flip cover comprises a protruding rod corresponding to a position of the anti-off hole.

6. The assembly and disassembly base according to claim 1, wherein:
the connecting member comprises a connecting base and two connecting sleeves disposed on opposite ends of the connecting base, and
an inner side of each of the two connecting sleeves is disposed with a damper.

7. The assembly and disassembly base according to claim 6, wherein:
the at least one fixed plate comprises two fixed plates, and
the two fixed plates are respectively disposed at a first side of the two connecting sleeves away from a toilet tank of the toilet.

8. The assembly and disassembly base according to claim 1, wherein:
the at least two protruding blocks comprise at least four protruding blocks,
the at least four protruding blocks are evenly disposed on the two sides of the top surface of the body at intervals,
a number of the plurality of locking blocks is equal to a number of the at least four protruding blocks,
a space between a first locking block and a second locking block of the plurality of locking blocks on each of the two sides enables a corresponding one of the at least four protruding blocks to pass through, and
the first locking block of the plurality of locking blocks is adjacent to the second locking block of the plurality of locking blocks.

* * * * *